US005540816A

United States Patent [19]

Andtbacka et al.

[11] Patent Number: 5,540,816

[45] Date of Patent: Jul. 30, 1996

[54] METHOD OF INTEGRATING BLEACHING AND RECOVERY IN THE PRODUCTION OF PULP

[75] Inventors: Stig Andtbacka; Anders Bergqvist, both of Karlstad; Lennart Hagelquist, Varberg; Daniel Pålsson, Karlstad, all of Sweden; Gunnar Wernqvist, Biot, France

[73] Assignee: Kvaerner Pulping Technologies AB, Karlstad, Sweden

[21] Appl. No.: 224,726

[22] Filed: Apr. 8, 1994

[30] Foreign Application Priority Data

Aug. 3, 1993 [SE] Sweden ..... 9302546

[51] Int. Cl.[6] ..... D21C 11/00; D21C 11/10

[52] U.S. Cl. ..... 162/29; 162/65; 162/78; 162/19; 162/33; 162/189; 159/47.3

[58] Field of Search ..... 162/65, 76, 78, 162/88, 89, 37, 19, 29, 39, 37, 189, 33; 159/47.3

[56] References Cited

U.S. PATENT DOCUMENTS

| | | | |
|---|---|---|---|
| 4,039,372 | 8/1977 | Reeve et al. | 162/19 |
| 4,466,861 | 8/1984 | Hultman | 162/38 |
| 4,595,455 | 6/1986 | Mannbro | 162/38 |
| 4,619,733 | 10/1986 | Kooi | 162/30.1 |
| 4,718,978 | 1/1988 | Spannuth et al. | 162/29 |
| 4,789,428 | 12/1988 | Ryham | 159/47.3 |
| 5,022,962 | 1/1991 | Korhonen et al. | 162/29 |
| 5,246,542 | 9/1993 | Fosberg et al. | 162/29 |
| 5,310,458 | 5/1994 | Lundgren et al. | 162/78 |
| 5,352,332 | 10/1994 | Maples et al. | 162/30.1 |
| 5,380,402 | 1/1995 | Ryham et al. | 162/30.1 |

*Primary Examiner*—Donald E. Czaja
*Assistant Examiner*—Jose A. Fortuna

[57] ABSTRACT

A method of integrating bleaching and recovery in connection with the production of chemical pulp that has been digested and preferably delignified with oxygen gas using processes that retain the viscosity and strength, to kappa number less than 16 without the use of chemicals containing chlorine, and using a bleaching sequence including at least one step with sequestering agent and/or acid, and a peroxide step. According to the invention spent liquor (5) from the bleaching department is pre-evaporated in one or more evaporation units (20F, 20G), and the spent liquor (24) from the bleaching department thus pre-evaporated is combined with spent liquor (22) from the digestery and/or with pre-evaporated spent liquor (23) from the digestery obtained by pre-evaporating spent liquor (22) from the digestery in one or more evaporation units (20D, 20E) other than said evaporation units (20F, 20G) for pre-evaporating spent liquor (5) from the bleaching department, after which the mixture of spent liquors (23, 24) is subjected to final evaporation in one or more evaporation units (20A, 20B, 20C) other than said evaporation units (20F, 20G, 20D, 20E) used for pre-evaporation.

26 Claims, 5 Drawing Sheets

METHOD OF INTEGRATING BLEACHING AND RECOVERY IN THE PRODUCTION OF PULP

The present invention relates to a method of integrating bleaching and recovery in the production of chemical pulp that has been digested and preferably delignified with oxygen gas using processes that retain the viscosity and strength, to a kappa number less than 16, preferably 12 and less, more preferably less than 10, without the use of chemicals containing chlorine, and using a bleaching sequence including at least one step with sequestering agent and/or acid, and a peroxide step.

Environmental protection authorities are making increasingly stringent demands on the pulp industry to reduce the use of chlorine gas and other compounds containing chlorine used in bleaching processes. The permissible discharge of organic chlorine compounds (AOX) with the waste water from the bleaching department has been gradually reduced and is now at such a low level that in many cases pulp factories have stopped using bleaching chemicals containing chlorine at all, i.e. without either chlorine gas or chlorine dioxide. Consumer demands have also increased for paper products that have been bleached entirely without the use of either chlorine gas or chlorine dioxide.

The pulp industry has therefore sought new methods which enable pulp to be bleached without the use of these chemicals. One such method has been developed by the Swedish company EKA and is known as the Lignox method (see SE-A-8902058 corresponding to EP-A2-0 402 335). This method is based on the use of a peroxide bleaching step (P). In order to achieve good results from the peroxide bleaching, the P-step is preceded by a sequestering step (Q), i.e. heavy metals in the pulp are removed with the aid of a sequestering agent such as EDTA. However, the Lignox method has drawbacks in that the brightness is only increased to a limited extent and the bleaching time is relatively long. Neither does the Lignox method solve the problem of the spent liquor from the bleaching department containing metal ions and remnants of peroxide. These drawbacks make commercial use of the method difficult.

A first object of the present invention is to offer a method that solves at least the majority of the problems mentioned above.

Another object of the invention is to enable the metals separated out from the bleaching process to be efficiently taken care of.

Still another object of the present invention is to integrate a preferred bleaching sequence with the recovery side in a simple manner.

Yet another object of the invention is to optimize the circulation of liquid in a fibre line so as to optimize the use of the washing equipment and/or to enable filtrate to be handled in an advantageous manner and/or to minimize the amount of liquid entering and leaving the bleaching department.

Another object of the invention is to cost optimize an evaporation plant for a bleaching department according to the invention completely free of chlorine (TCF), wherein one and the same heat source is used for pre-evaporation of the various part-flows, i.e. spent liquors from the digestery and bleaching department, respectively.

The method according to the invention is substantially characterized in that spent liquor from the bleaching department is pre-evaporated in one or more evaporation units, and that the spent liquor from the bleaching department thus pre-evaporated is combined with spent liquor from the digestery and/or with pre-evaporated spent liquor from the digestery obtained by pre-evaporating spent liquor from the digestery in one or more evaporation units other than said evaporation units for pre-evaporating spent liquor from the bleaching department, after which the mixture of spent liquors is subjected to final evaporation in one or more evaporation units other than said evaporation units used for pre-evaporation.

According to a preferred embodiment of the method according to the invention the evaporation phases occur in an evaporation plant driven at least primarily by one and the same heat source.

The invention will be described further in the following with reference to the accompanying drawings.

Figures 1, 2:
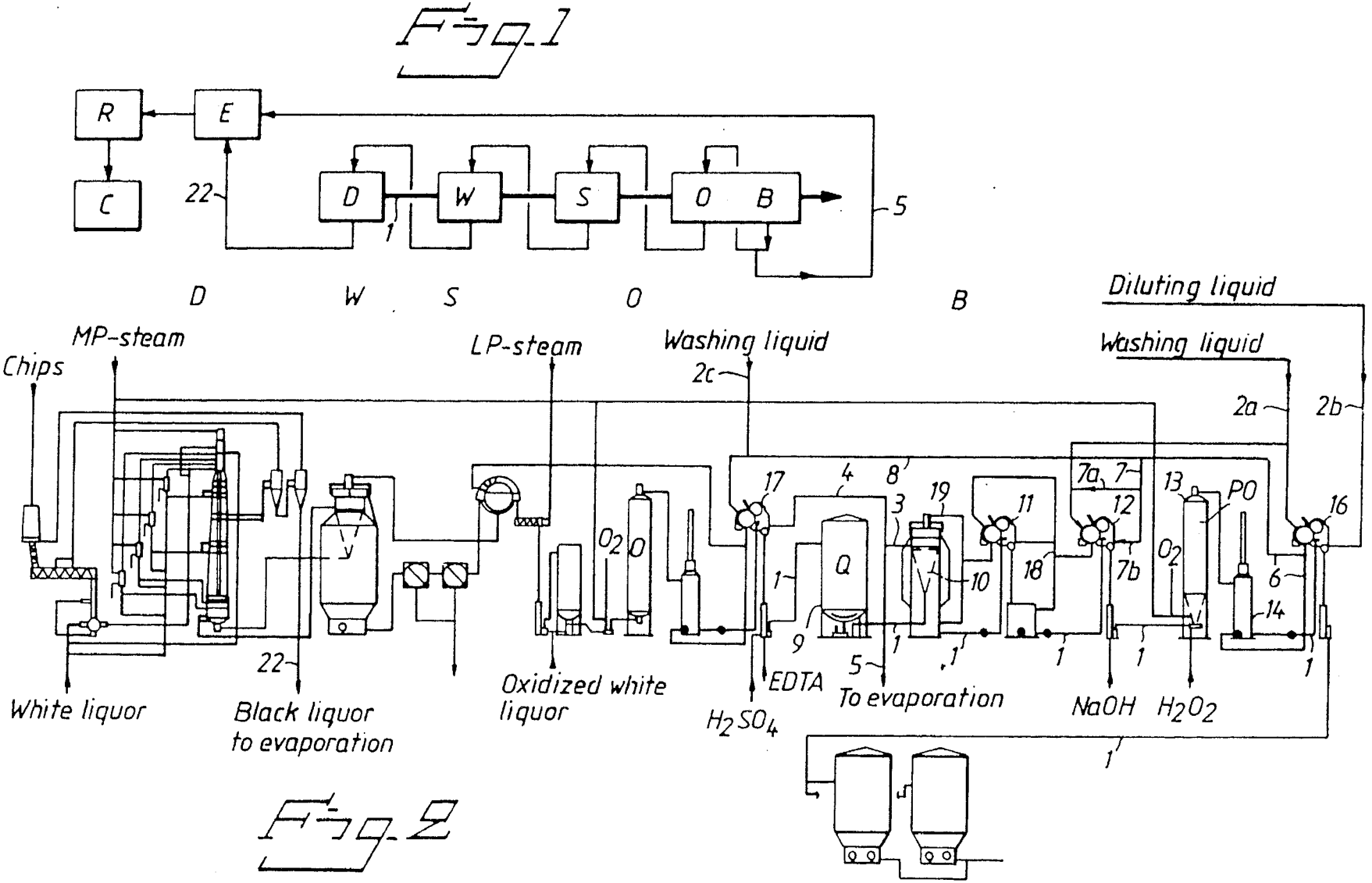
FIG. 1 illustrates a block diagram of the basic principle of the invention.
FIG. 2 shows a digestery and bleaching department with a fibre line and filtrate flows according to a preferred embodiment of the invention.

In the form of a block diagram FIG. 1 shows how a fibre line comprising the process units D, W, S, O, B (see also FIG. 2) can be integrated in a suitable way with the recovery system E, R, C according to the invention. The flow path of the pulp is indicated by the bold line 1. The pulp is fed from a digester D, preferably a continuous digester for digesting in accordance with the ITC technique. The pulp is then washed in washing equipment W, screened in screening equipment S and delignified with oxygen gas in a reactor O to low kappa number, preferably less than 12 for softwood and 9 for hardwood. After being delignified with oxygen gas the pulp is washed in at least one step and bleached in the bleaching department B in a chlorine-free bleaching sequence providing good separation of undesired substances, preferably metals. As can be seen in FIG. 2, the number of washing apparatuses after delignification with oxygen gas can be reduced to only one washing apparatus 17 by means of the preferred embodiment.

A first part 5 of the metal containing spent liquor 3 from the bleaching department B is supplied directly to the evaporation plant unit E while the other part 4 is supplied in counterflow all the way to the digester D before being conveyed to the evaporation plant E in the form of spent liquor 22. After common final evaporation the mixture of spent liquors is conveyed to the recovery unit R (soda recovery unit, Chemrec-reactor, etc.). From here inorganic material is passed on to the causticizing unit C where undesired metals are suitably removed during clarification of the green liquor.

Figure 3:
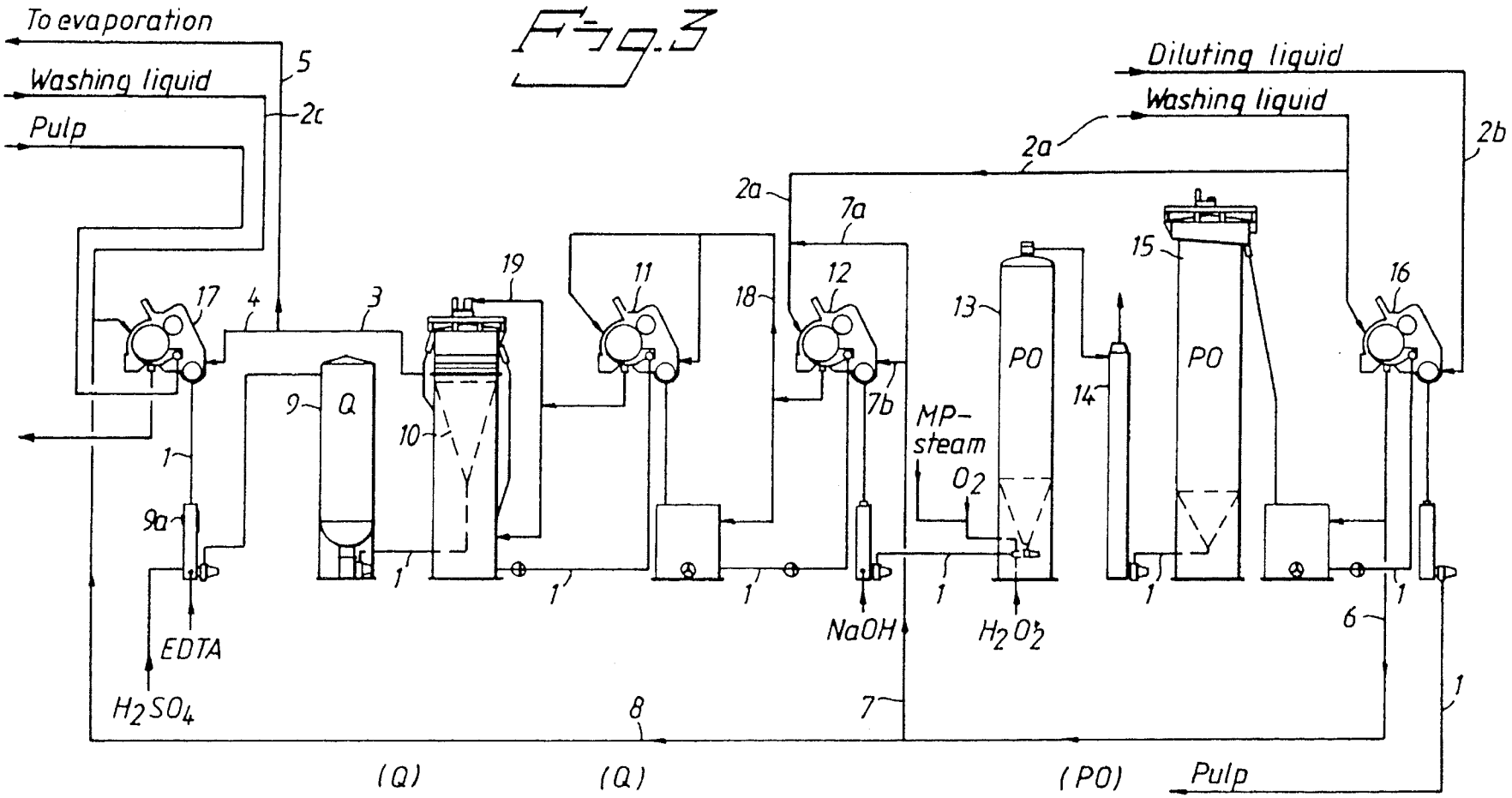
FIG. 3 shows a bleaching department with a fibre line and filtrate flows according to another embodiment of the invention.

FIG. 3 shows a process line comprising a bleaching department B and parts of the system for delignification with oxygen gas. The only difference between the bleaching department shown in FIG. 3 and that shown in FIG. 2 is that a vessel 15, open to the atmosphere, has been added following the peroxide step in the process line according to FIG. 3. The pulp flow is denoted by reference number 1 in FIG. 3 also. The bleaching sequence commences with a sequestering step performed in a vessel 9. Washing is then effected by displacement of liquid in a diffuser 10 followed by two washing apparatuses 11, 12. Thereafter follow a peroxide step performed in a pressurized reactor 13, a pressure release tank 14, an atmospheric bleaching tower 15 and finally a washing apparatus 16.

According to a preferred embodiment, thus, the peroxide step comprises a pressurized reactor 13 which preferably operates at a pressure exceeding 2 bar (absolute pressure), this value referring to the pressure at the top of the bleaching vessel (without any real static pressure). This pressure level is suitably maintained by means of a pump (e.g. MC-pump). A temperature exceeding 100° C. is preferred in such a pressurized peroxide step.

Washing liquid 2*a* in the form of fresh water and/or white water and/or condensate from pre-evaporation of the spent liquor 5 from the bleaching department or the like is supplied to the washing apparatus 16 in the bleaching department. Diluting liquid 2*b* may also be supplied to the washing apparatus 16. The filtrate 6 from this washing apparatus 16, normally containing peroxide remnants, is divided into two fractions 7 and 8, one fraction 7 being supplied to the last washing apparatus 12 for metal separation after the sequestering step, and the other fraction 8 being supplied to the final and only washing apparatus 17 after delignification with oxygen gas step for use in the last-mentioned case as washing liquid. The division of the two fractions 7 and 8 is such that fraction 8 constitutes at most about 37% of said filtrate 6 and fraction 7 thus constitutes at least about 63% of the filtrate 6. This division is calculated on the filtrate 6 remaining after the branching shown for the possible addition of diluting liquid to the pulp after the peroxide step. The fraction 7 may be used as washing liquid 7*a* and/or diluting liquid 7*b* in said washing apparatus 12, in which case the washing liquid 7*a* may constitute at most about 40% and the diluting liquid 7*b* at most about 60% of the amount of filtrate 6 from the washing apparatus 16, at which limit values the filtrate 8 is thus 0%. Fresh water and/or white water and/or condensate is used as washing liquid 2*a* for the last wash in the washing apparatus 12 after the treatment with sequestering agent. The filtrate 18 from this wash in the washing apparatus 12 is conveyed countercurrent to washing steps ahead performed in the washing apparatus 11 and the diffuser 10, and the filtrate 3 after the first wash in the diffuser 10 is divided into two part-filtrates 4, 5. The one part-filtrate 4 is then used as diluting liquid after the wash in the washing apparatus 17 after the delignification with oxygen gas, and the other part-filtrate 5 is conveyed to the evaporation plant E. These part-filtrates 4, 5 have high contents of metals and contain at least 5 ppm Mn, e.g. 10–50 ppm Mn. Thus the metal containing part-filtrate 5 constitutes the share of the spent liquor from the bleaching department which is conveyed to the evaporation plant E and thereafter to thermal decomposition in a reactor R. The metals are then preferably separated out when the green liquor is being dealt with. If desired, the washing apparatus 17 may be supplied with washing liquid 2*c* in the form of condensate from evaporation of spent liquor 22 from the digestery or fresh liquid.

Figure 4:
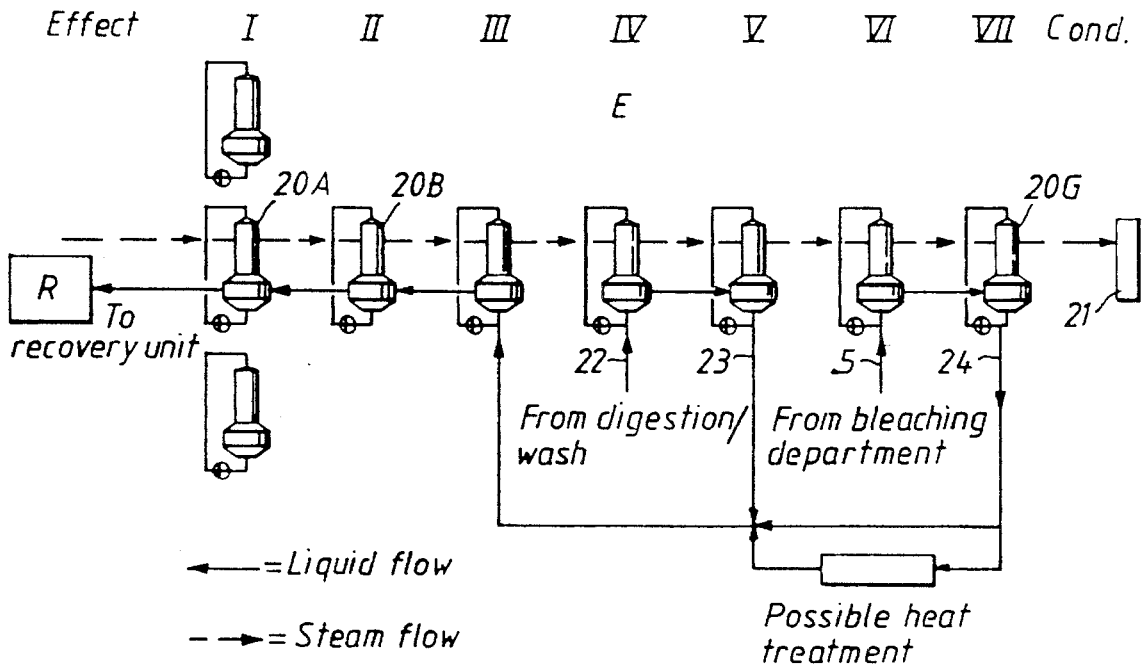
FIG. 4 shows a flowchart for evaporation of spent liquors according to the invention.

The evaporation plant E according to FIG. 4 comprises seven effective outputs, i.e. evaporation units 20A–G, and a condenser 21. According to a greatly preferred embodiment of the invention, all evaporation units 20 have the same original heat source, viz. the fresh steam supplied to the first evaporation unit 20A. The second evaporation unit 20B is driven by the liquor vapour stripped from the first evaporation unit 20A, and the third evaporation unit 20C is driven by the liquor vapour stripped from the second evaporation unit 20B, etc. Hot or warm water is produced in the condenser 21. Three apparatuses are used in the first evaporation unit, to enable them to be cleaned in turn from encrustations.

The increased number of evaporation units (normally 5 or 6) also means that spent liquor from both the bleaching department and the digestery can be dealt with the one and the same evaporation plant E, thereby avoiding the expense of double evaporation plants.

According to the preferred example shown the spent liquor 5 from the bleaching department is supplied to the sixth evaporation unit 20F to be pre-evaporated there and in the subsequent seventh evaporation unit 20G. Separate evaporation of the spent liquor from the bleaching department gives the advantage that a relatively pure condensate is obtained which can be recirculated to the bleaching department B, while also avoiding problems of foaming caused by low dry solids contents.

Spent liquor 22 from the digestery is supplied to the fourth evaporation unit 20D, and then to the fifth evaporation unit 20E for pre-evaporation. Thereafter the two pre-evaporated spent liquors 23, 24 are combined and this mixture is supplied to the third evaporation unit 20C for sequential final evaporation in this and in the second and first evaporation units. The mixture of spent liquors is finally conveyed to a soda recovery unit, a so-called Chemrec-reactor or other equipment R for the thermal decomposition.

Before the pre-evaporated spent liquor 24 from the bleaching department is combined with the pre-evaporated spent liquor 23 from the digestery it may be advantageous to subject the spent liquor 24 from the bleaching department to heat treatment in order to decompose oxalate which might otherwise give rise to encrustation in the form of calcium oxalate. The number of evaporation units, the location of the evaporation units being used and the flow paths can of course be varied to a considerable extent.

An existing evaporation plant can be expanded to enable utilization of the method according to the invention. Such expansion is economically favourable in many cases.

In the bleaching process the amount of liquid added should be about twice as much as the amount of filtrate leaving, which is removed from the bleaching department and supplied to the evaporation plant. According to the invention, the amount of filtrate 5 supplied to the evaporation plant is preferably less than 60%, more preferably less than 40%, and most preferably less than 25% of the amount of liquid 2*a*, 2*b*, 2*c*.

According to the most preferred embodiment the amount of fresh washing water supplied to the step for delignification with oxygen gas is zero or very close to zero. In general, the amount of fresh washing water added to the oxygen gas delignification step is less than 5 $m^3$/ADMT and preferably less than 2 $m^3$/ADMT Air Dry Metric Ton.

The invention is not limited to the embodiments described above but can be varied in many ways within the scope of the following claims. Additional bleaching steps may thus be added before, between or after the shown steps with sequestering agents and peroxide. A preferred supplementary bleaching step is ozone, for instance. The delignification with oxygen gas after digestion may be omitted if so desired but its inclusion is preferred. Regardless of whether such oxygen gas delignification is performed after digestion or not, the bleaching sequence may comprise one or more oxygen gas steps. According to the drawings washing presses are used in the first place when washing the pulp in the stages using sequestering agent and peroxide. However, the invention is naturally not limited to this and other known washing apparatus may be used such as pressure diffusers, filters or the atmospheric diffuser (or double diffuser) shown in an earlier step. After the step with sequestering agent and/or acid the washing apparatuses have a washing efficiency of at least 85%, preferably at least 90%, and more preferably at least 95%.

Neither is the invention limited to the use of one evaporation plant. It is thus also possible to perform evaporation in two or more plants, parts of plants or whole plants being used for evaporation of spent liquor from the bleaching department, while other parts of the plants are used for evaporation of spent liquor from the digestery.

Any evaporation technique whatsoever can be used, e.g. rise film, fall film, forced circulation and multi-flash techniques.

Figure 5:
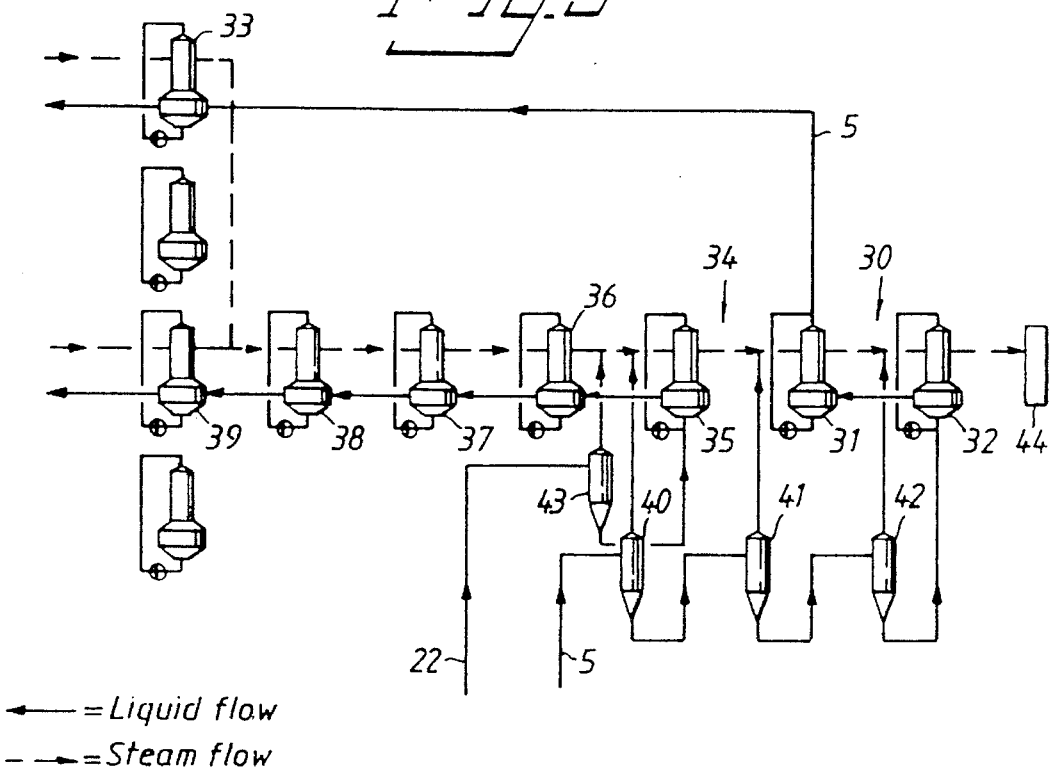
FIG. 5 shows a flowchart for evaporation of spent liquors in accordance with a modified method of the invention.

FIG. 5 shows a flowchart for an evaporation plant for evaporation of spent liquor 5 from the bleaching department and spent liquor 22 from the digestery, according to a modified method according to the invention. The evaporation plant consists of a first line 30 comprising two evaporation units 31, 32 for pre-evaporation of spent bleaching liquor 5, and an evaporation unit 33 for final evaporation of the pre-evaporated spent bleaching liquor, and a second line 34 comprising two evaporation units 35, 36 for pre-evaporation of spent digestion liquor 22 and three evaporation units 37, 38, 39 for final evaporation of the pre-evaporated spent digestion liquor.

The first line 30 begins with three flash cyclones 40, 41, 42 to reduce the pressure, the steam released being conducted to various points along the two lines 30, 34, while the second line 34 begins with one relief cyclone to reduce the pressure, the released steam being conducted to the second line 34.

The two evaporation lines 30, 34 are thus separated from each other with regard to the two spent liquor flows 5, 22. On the other hand, they are connected with regard to the heat supply system since, according to a greatly preferred embodiment of the invention, all evaporation units in the two lines 30, 34 are driven by the same heat source, i.e. the fresh steam that is fed into the two evaporation units 33, 39 for final evaporation of the spent liquor from the bleaching and digesting departments, respectively. Each subsequent evaporation unit, e.g. 38, thus utilizes the liquor steam produced in a preceding evaporation unit, e.g. 39, seen in opposite direction to the flow direction of the spent liquor from the digestery. Thus the liquor steam produced in the evaporation unit 33 of the first line 30 for final evaporation of spent digestion liquor is supplied to the second line 34 to be combined with the liquor steam from the evaporation unit 39 for final evaporation of the spent digestion liquor. The liquor steam produced in evaporation unit 35 in the second line 34 to which spent digestion liquor 22 is supplied to initiate the pre-evaporation, is used in evaporation unit 31 in the first line 30, in which pre-evaporation of spent bleaching liquor 5 occurs in a final step prior to final evaporation. The liquor steam produced in evaporation unit 32 in the first line 30 to which spent bleaching liquor 5 is supplied to initiate pre-evaporation, is conveyed to a condenser 44 for the production of hot or warm water.

The evaporated spent bleaching liquor is used as fuel, while the evaporated spent digestion liquor is conveyed to a recovery plant such as a soda recovery unit, for recovery of the digestion chemicals.

The number of evaporation units in each line and the distribution of the evaporation units in the two lines may be varied within wide limits, depending on the evaporation requirement and steam economy in each individual case.

Figure 6:
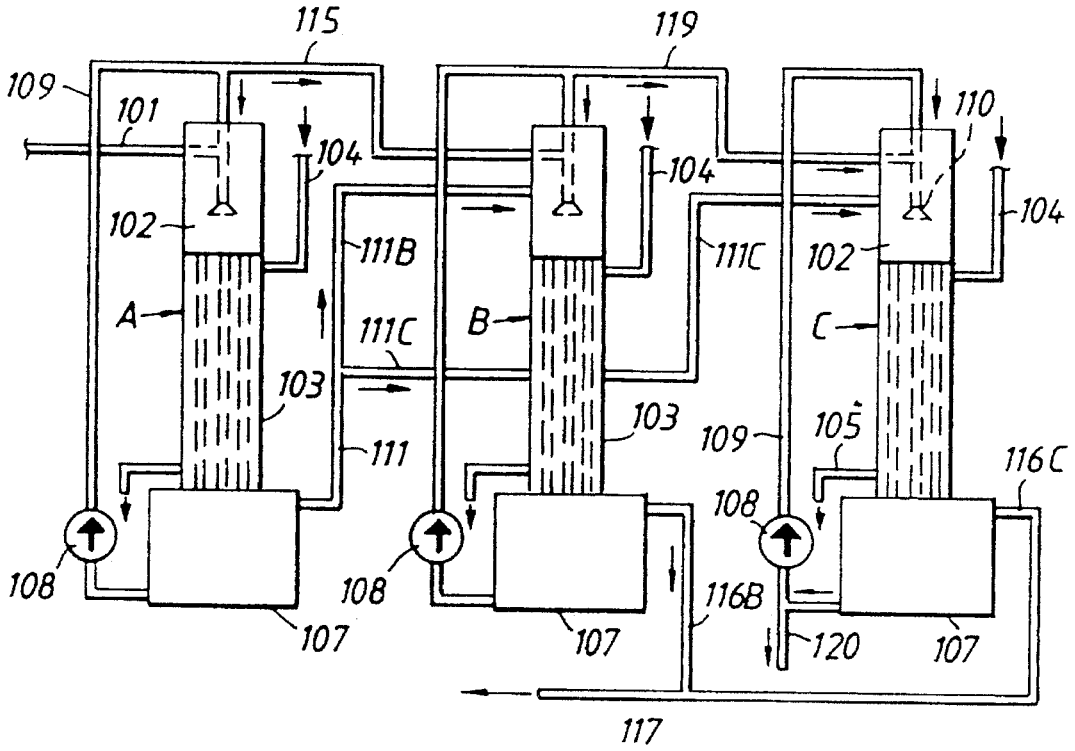
FIG. 6 shows three evaporators in a final evaporation step which may be included in an evaporation plant as shown in FIG. 4, for instance.
Figure 7:
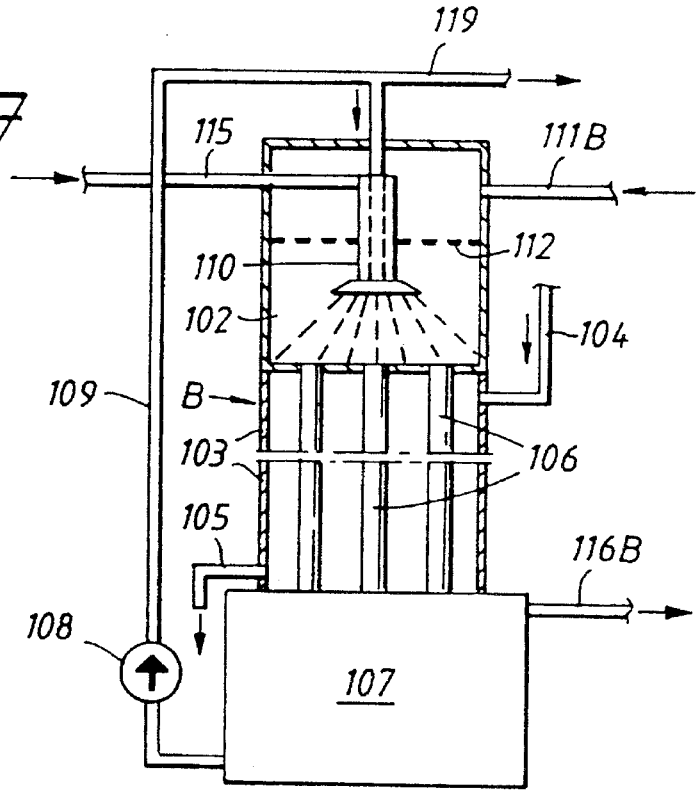
FIG. 7 shows in more detail the middle one of the three evaporators in FIG. 6.

FIG. 6 shows schematically a final evaporation step which may be included in a plant according to FIGS. 4 and 5. The partially concentrated spent liquor from the earlier pre-evaporation steps is supplied through a pipe 101 to an evaporator A. Evaporator A and two other evaporators, B and C, comprise the final evaporation step. Each evaporator comprises an upper inlet chamber 102 and a heat zone 103 provided with supply pipe 104 for fresh steam and an outlet pipe 105 for condensate. The fresh steam serves to indirectly heat the spent liquor flowing down from top to bottom along the inner sides of pipes 106 (FIG. 7) to a collection vessel 107. Steam is removed through a pipe 111. A part of the spent liquor is recirculated by the pump 108 through the pipe 109. Spent liquor coming from another evaporator and the recirculated spent liquor are supplied together through a spray head 110 and sprayed in downward direction. If steam from another evaporator is also supplied to the inlet chamber 102 through a pipe 111B and 111C, a distributor plate 112 may be arranged in the chamber 102 between the outlet of the pipe 111B and the outlet of the spray head 110. The plate 112 is perforated, or like a strainer, to ensure that the steam is distributed to the inlets of the pipes 106 as uniformly as possible. The partially concentrated spent liquor supplied through pipe 101 and the recirculated spent liquor are sprayed together into the chamber 102 of the evaporator A and conducted down through the associated heat zone 103. Concentrated spent liquor is withdrawn through a pipe 115 and supplied to evaporator B. The pressure of the steam produced in evaporator A is somewhat higher than that in the inlet chambers of evaporators B and C. Either all or part of said steam is supplied via pipe 111B to evaporator B and either all or part via pipe 111C to evaporator C. The steam produced in evaporators B and C is withdrawn through pipes 116B and 116C to the collection pipe 117 connected to the other part of the evaporation plant, and is used to heat the spent liquor in this part where pre-evaporation thus occurs. A part of the recirculated spent liquor from evaporator B is withdrawn through pipe 119 to evaporator C, in which the final concentration is obtained. Highly concentrated spent liquor is withdrawn from the evaporation plant through pipe 120 and supplied to a recovery plant. The evaporators may be equipped with a device for separating the condensate so that a small part of the condensate contains the majority of organic substances in the steam, and a larger part of the condensate contains small amounts of the same substances.

Figure 8:
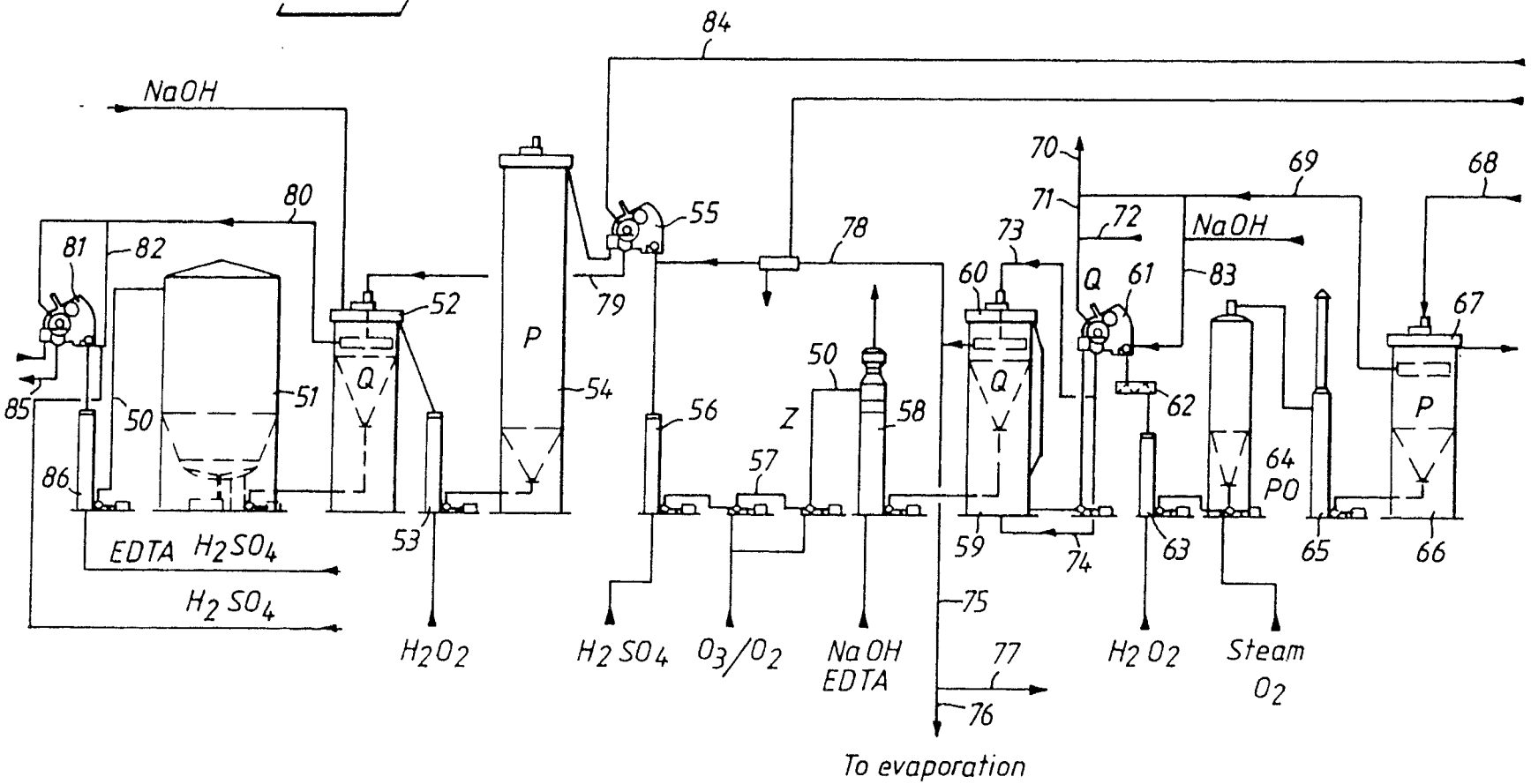
FIG. 8 shows a bleaching department with washing step and the filtrate flows enabling a closed bleaching process.

FIG. 8 shows schematically a bleaching department in which pulp is supplied continuously in a fibre line 50 marked with a thicker line. This bleaching department is designed to carry out a bleaching sequence entirely free from chlorine, comprising the following steps: QP(ZQ)(PO). The sequestering agent (e.g. EDTA) containing the pulp is pumped from a tower 51 to a diffuser 52 for complex-bound metals to be leached out, and thereafter via a down pipe 53 to a bleaching tower 54 for peroxide bleaching. From this P bleaching tower 54, the pulp is supplied to a first washing press 55 and thereafter via a down pipe 56 to a mixer 57 where ozone is supplied and mixed in. The pulp is then pumped to a gas separator 58 which is followed by a tower 59 where the pulp is treated with sequestering agent, said tower 59 being provided at the top with a diffuser 60. From the storage space at the bottom of the tower 59 the pulp is pumped to a second washing press 61, followed by a heating device 62 for lower pressure steam and a down pipe 63. From there the pulp is pumped in at the bottom of a pressurized bleaching vessel 64, the pressure at the top being at least 3 bar, preferably approximately 5–10 bar. The pulp is supplied from the top of the pressurized bleaching vessel 64 to a pressure relief vessel 65, and then to a final bleaching tower 66 with a diffuser 67 at the top.

Washing liquid in the form of white water or fresh water is added to the final diffuser 67 through a pipe 68. Filtrate from the final diffuser 67 is conveyed initially to evaporation through pipes 69 and 70. A part of the filtrate from the final diffuser 67 may be supplied from the start to the second washing press 61 via said pipe 69 and a pipe 71 leading therefrom, via a valve (not shown). White water or fresh water or some other suitable washing liquid may be used in the second washing press 61 instead of filtrate, this alternative washing liquid being supplied via a pipe 72 preferably connected to said pipe 71. A part of the filtrate from the diffuser 67 may also be used as dilution liquid and is then supplied via a pipe 83 to a point on the fibre line 50 located downstream of the other washing press 61. The filtrate from the other washing press 61 is conveyed to the middle diffuser 60 via a pipe 73. A part of this filtrate can be supplied through a pipe 74 to the bottom of the storage tower 59 for use as dilution liquid.

The filtrate from the middle diffuser 60 is withdrawn through a pipe 75 which, via a two-way valve (not shown) branches into two pipes 76 and 77. A part of this filtrate may be supplied via a pipe 78 to a point on the fibre line 50 located downstream of the first washing press 55, to be used as dilution liquid. Pipe 76 is connected to the recipient, whereas pipe 77 is connected to the evaporation plant with which the bleaching plant is integrated.

The first washing press 55 is supplied with hot water (60° C.) through a pipe 84. The filtrate from the first washing press 55 is used as washing liquid in the first diffuser 52 and conducted to this through a pipe 79. The filtrate from this first diffuser 52 is conducted through a pipe 80 to a washing press 81 not associated with the bleaching department. A part of this filtrate can be used as dilution liquid and is supplied via a branch pipe 82 to the pulp fibre line 50 at a point downstream of the washing press 81. Alternatively, all or a part of this filtrate may be carried to evaporation and/or away to the recipient.

The washing press 81 in the bleaching line is used primarily for washing out organic material, in which case the filtrate is preferably conveyed via a pipe 85 to the preceding washing apparatus usually included in a plant for oxygen delignification. The washing press 81 is also used for the purpose of regulating optimum pulp consistency to a subsequent down pipe 86 constituting a buffer for pumping to the tower 51. Sequestering agent, preferably EDTA, is added when pulp is pumped to or from the tower 51, and the pH value is adjusted to preferably pH 4–6. The sequestering agent can act in the cone leading to the diffuser 52, metals thus being bound to the complex. The metal-containing complex is washed to the desired extent in the diffuser 52. It is advantageous for this wash not to be performed to too high a degree of washing efficiency, this being preferably less than 90%, preferably less than 85% and more preferably between 70 och 80%. After the diffuser 52 the pH value is increased, preferably by the addition of sodium hydroxide. A relatively small quantity of peroxide (less than 10 kg $H_2/O_2$/ADMT) is added in the down pipe 53 after the diffuser 52 during pumping out. This is mainly intended to have a delignifying effect on the pulp in the first P-bleaching tower 54. Washing in the washing press 55 follows the first P-step. A washed pulp of the desired consistency has now been obtained in the down pipe 56 prior to the ozone step. The addition of a suitable acid, e.g. sulphuric acid, lowers the pH value to a suitable level for ozone bleaching, preferably pH 2–5. The pulp is then pumped to the mixer 57 where ozone gas is added. Two or more mixers are preferably used, arranged in series with each other, in order to thoroughly mix pulp and ozone. The ozone-bleached or delignified pulp is then conveyed further to the degasification vessel 58. After the ozone step, without intermediate wshing, follows a second treatment with sequestering agent, which is then followed by washing with very good washing efficiency. A washing efficiency of at least 85%, preferably at least 90% and most preferably at least 95% should be achieved with the washing steps carried out in the diffuser 60 and washing press 61. Steam, e.g. low-pressure steam, is mixed in in the heating device 62 with the object of increasing the temperature before the subsequent pressurized peroxide step in the bleaching vessel 64. In this bleaching vessel a great deal of the bleaching of the fibres in the pulp is achieved by the addition of NaOH and a relatively high dose of peroxide (a higher dose of peroxide than in the preceding step). A certain amount of oxygen gas may also be added in a mixer arranged at the bottom of the pressurized peroxide bleaching vessel 64. The pulp is further spared by maintaining the pH value below 11.5 (relatively low) in this bleaching vessel 64, and a bleached pulp having been properties than normally can therefore be obtained. The bleached pulp is supplied to the top of the bleaching vessel 64 and conveyed to the relief device 65 from whence it is carried to the extra bleaching tower 66 before being bleached with the remaining peroxide. The final wash is performed at the top of said bleaching tower 66, with the aid of the diffuser 67.

The combination of ozone and sequestering agent described produces excellent metal separation, which is a great advantage to the pressurized peroxide step. An organic per acid or a peroxide may be used instead of ozone in the delignifying acid step.

It will be understood that the washing apparatuses described may be replaced with similar apparatuses having similar function, and that a diffuser functions essentially according to the constriction wash principle and a washing press according to the constriction and thickening principle.

During the first stage of the bleaching process the filtrate flowing through the pipe 74 is conveyed from the middle diffuser 60 to the recipient via pipe 76. This filtrate, which is acid and contains relatively large quantities of metals such as calcium, is one of the more polluted wastes from the bleaching department and has hitherto been impossible to deal with in an evaporation plant without problems arising which resulted in reduced capacity and efficiency in the evaporation process. Calcium causes "scaling" in the evaporators, for instance, that is to say, hard deposits which can only be removed after dismantling the evaporators and cleaning and/or exchanging certain parts. The problems have prevented the bleaching department from being operated as a closed system. Instead, some of the waste always had to be discharged to the recipient. The present invention aims at eliminating these problems and drawbacks and providing the criteria for a completely closed bleaching system without any discharge to the recipient. However, the transition to a completely closed bleaching system is complicated and must be carried out gradially in order to gradually adjust the evaporation to the altered circumstances. Adjustment of the valve between pipes 76, 77 permits a certain proportion of the filtrate from the ozone step, which is discharged to the recipient via pipe 76, to flow instead through pipe 77 to the evaporation plant. At the same time the supply of filtrate from the peroxide step to the evaporation plant through pipe 70 is correspondingly reduced so that the combined quantity of filtrate to the evaporation plant is substantially the same from these two sources of filtrate. This corresponding quantity of filtrate is instead carried to the second washing press 61 and consequently the amount of fresh or white water flowing through pipe 72 to this washing press 61 can be correspondingly reduced. In connection with the evaporation measures are taken such that the specific filtrate from the wash after the bleaching step, that may be an ozone or peroxide step, can be dealt with without causing an interruption in operation. One such measure may be that one or more evaporation units are duplicated so that different flow paths can be chosen for the filtrate, thereby permitting a disconnected evaporation unit showing "scaling" to be cleaned, while the filtrate is conveyed through an evaporation unit cleaned from "scaling". Other measures may consist of adjusting the pH of the solution before or during evaporation so that "scaling" is avoided or adjusting the pH so that a precipitation is obtained before or during the evaporation process, said precipitation being separated from the solution by means of separation technique, e.g. filtration, before, during or after completed pre-evaporation of the spent liquor from the bleaching department. It may be suitable to add $Na_2CO_3$, $Na_2SO_4$, CaO, $Ca(OH)_2$, $CaSO_4$, $CaCO_3$, MgO, Mg(OH), $MgCO_3$, $MgSO_4$, or combinations thereof, including green liquor, lime sludge or lime, before, during or after the pre-evaporation in order to facilitate separation and prevent precipitation on the heat-transfer surfaces in the evaporation unit and instead force the precipitation to occur preferably in the solution.

When the evaporation has been adjusted to take care of said first share of the filtrate from the ozone step, the procedure can be repeated with an increased share of the filtrate from the ozone step to the evaporation plant and additional measures in the evaporation plant, and so on, until all filtrate from the ozone step can be dealt with by the evaporation plant without any interruption, i.e. with maintained capacity and efficiency, and the bleaching process becomes an entirely closed one.

We claim:

1. In a method of integrating bleaching and recovery in the production of chemical pulp that has been digested and delignified with oxygen gas using processes that retain the viscosity and strength, to a kappa number less than 16, without the use of chemicals containing chlorine, the improvement comprising using a bleaching sequence including at least one step with a sequestering agent and a peroxide step, wherein the spent liquor from the bleaching sequence is pre-evaporated in evaporation units and then combined with spent liquor from the digestion step obtained by pre-evaporating spent liquor from the digestion stage in at least one evaporation unit other than said evaporation units for pre-evaporating spent liquor from the bleaching sequence, after which the mixture of spent liquors is subjected to final evaporation in at least one evaporation unit used for pre-evaporation.

2. A method as claimed in claim 1, characterized in that the evaporation of the spent liquors occur in an evaporation plant (E) utilizing at least primarily one and the same heat source.

3. A method as claimed in claim 1 or 2, characterized in that the spent liquor (5) from the bleaching stage sequence is pre-evaporated in at least two evaporation units (20F, 20G).

4. A method as claimed in claim 1, characterized in that washing liquid (8) is used in a washing step after the delignification with oxygen gas, said washing liquid comprising the filtrate (6) from a washing step performed after a bleaching step which in turn is performed after said sequestering step, said filtrate (6) derived from the washing step after said peroxide step.

5. A method as claimed in claim 1, characterized in that the amount of fresh washing liquid added to the washing step after the delignification with oxygen gas is less than 7 $m^3$/ADMT Air Dry Metric Ton of Pulp.

6. A method as claimed in claim 1, characterized in that the pre-evaporated spent liquor (24) from the bleaching department is heat-treated before being combined with the spent liquor (23) from the digestion sequence.

7. A method as claimed in claim 1, characterized in that said mixture of spent liquors (23, 24) is heat-treated.

8. A method as claimed in claim 1, characterized in that the amount of spent liquor (5) from the bleaching department transferred for pre-evaporation is less than 60% of the amount of liquid (2*a*, 2*b*, 2*c*) supplied to the bleaching sequence.

9. A method as claimed in claim 1, characterized in that the amount of spent bleach liquor (5) transferred from the bleaching sequence to pre-evaporation is limited to at most 7 $m^3$ liquid/Air Dry Metric Ton.

10. A method as claimed in claim 1, characterized in that the filtrates from the various bleaching steps are distributed in such a way that at least 50% of the filtrate (5) leaving the bleaching sequence comprises of filtrate (3) from the washing step performed in a washing apparatus (10) after the sequestering step.

11. A method as claimed in claim 10, characterized in that the filtrate (3) from the washing step in said washing apparatus (10) after the sequestering step is divided into a part-filtrate (4) which is used in a washing step in a washing apparatus (17) after delignification with oxygen gas, and a second part-filtrate (5) which is supplied to the evaporation units (E), the amount of said first part-filtrate (4) exceeding the amount of said second part-filtrate (5).

12. A method as claimed in claim 1, characterized in that each of the washing apparatuses (10, 11, 12) used in the washing step after the sequestering step has a degree of washing efficiency of at least 85%.

13. A method as claimed in claim 1, characterized in that said peroxide step is performed at a pressure exceeding 2 bar and at a temperature exceeding 100° C.

14. A method as claimed in claim 1, characterized in that only one washing apparatus (17) is used for the washing step between delignification with oxygen gas and the sequestering step.

15. The method as claimed in claim 1 characterized in that the amount of fresh washing liquid added to the washing step after the delignification with oxygen gas is less than 5$m^3$/Air Dry metric ton of pulp.

16. The method as claimed in claim 1 characterized in that the amount of spent liquor from the bleaching stage transferred for pre-evaporation is less than 40% of the amount of liquid supplied to the bleaching sequence.

17. The method as claimed in claim 1 characterized in that the amount of liquor from the bleaching sequence transferred for pre-evaporation is less than 25% of the amount of liquid supplied to the bleaching stage.

18. The method as claimed in claim 1 characterized in that the amount of spent bleach liquor transferred from the bleaching sequence to a pre-evaporation unit is limited to at most 5 $m^3$ liquids/metric ton of pulp.

19. The method as claimed in claim 1 characterized in that the amount of spent bleach liquor transferred from the bleaching sequence to a pre-evaporation unit is limited to at most 3 $m^3$ liquid per metric ton of pulp.

20. The method as claimed in claim 1 characterized in that each of the washing apparatuses used in the washing step after the sequestering step has a degree of washing efficiency of at least 90%.

21. The method as claimed in claim 1 characterized in that each of the washing apparatuses used in the washing step after the sequestering step has a degree of washing efficiency of at least 95%.

22. The method as claimed in claim 1 characterized in that said peroxide step is performed at a pressure exceeding 4 bar.

23. The method as claimed in claim 1 characterized in that said peroxide step is performed at a pressure exceeding 6 bar.

24. In a method of integrating bleaching and recovery in the production of chemical pulp that has been digested in a digestion stage and delignified with oxygen gas using processes that retain the viscosity and strength, to a kappa number less than 16 without the use of chemicals containing chlorine, the improvement comprising using a bleaching sequence including at least one acid step with one of ozone, an organic per acid, peroxide and with a sequestering agent, without intermediate washing, and a subsequent step with peroxide, wherein the filtrate obtained from a washing step after said acid step, which is normally discharged to the recipient, is instead conveyed in gradually increasing amounts to an evaporation plant, while the amount of filtrate discharged to the recipient and the amount of filtrate conveyed to the evaporation plant and deriving from a washing step after said peroxide step is correspondingly gradually decreased, so that the total amount of filtrate from said two washes to the evaporation plant is substantially constant, gradually increasing shares of the last-mentioned filtrate being conveyed in countercurrent to the pulp flow as washing liquid for the first-mentioned wash, and that gradually adjusting the evaporation to the gradually increased shares of filtrate from wash after the acid step, with maintained capacity and efficiency in the evaporation step, the bleaching process thereby gradually acquiring an increased degree of closing with all of said filtrate from wash after said acid step then being conveyed to the evaporation step instead of to the recipient and at the same time all filtrate from wash after the peroxide step being conveyed in countercurrent as washing or dilution liquid.

25. A method as claimed in claim 24, characterized in that said adjusting of the evaporation comprises adjusting the pH value of the filtrate.

26. In a method of integrating bleaching and recovery in the production of chemical pulp that has been digested and preferably delignified with oxygen gas using processes that retain the viscosity and strength, to a kappa number less than 16 without the use of chemicals containing chlorine, the improvement comprising using a bleaching sequence including at least one step with a sequestering agent and a peroxide step, wherein the spent liquor from the bleaching sequence is pre-evaporated in evaporation units and thereafter finally evaporated in a first line comprising at least two evaporation units; that spent liquor from a digestion step is pre-evaporated and thereafter finally evaporated in a second line comprising at least two evaporation units and being separated from said first line as regards the flow of liquor; that all evaporation units in the two lines make use of substantially the same heat source, fresh steam being supplied to the evaporation units for final evaporation in each line, and liquor steam from the evaporation unit of the first line for final evaporation of the spent bleaching liquor being supplied to the second line to be combined with liquor steam from the evaporation unit of the second line for final evaporation of the spent digestion liquor.

* * * * *

UNITED STATES PATENT AND TRADEMARK OFFICE

CERTIFICATE OF CORRECTION

PATENT NO. : 5,540,816
DATED : July 30, 1996
INVENTOR(S) : Andtbacka et al.

It is certified that error appears in the above-identified patent and that said Letters Patent is hereby corrected as shown below:

Column 9,
Line 54, after "unit" insert -- other than said evaporation units --.

Signed and Sealed this

Twenty-fifth Day of December, 2001

*Attest:*

*Attesting Officer*

JAMES E. ROGAN
*Director of the United States Patent and Trademark Office*